United States Patent [19]

Lewis

[11] Patent Number: 5,042,087

[45] Date of Patent: Aug. 27, 1991

[54] TIE PROTECTOR SHIELD

[76] Inventor: Louis Lewis, 39 High Ridge Rd., Monroe, Conn. 06468

[21] Appl. No.: 446,974

[22] Filed: Dec. 6, 1989

[51] Int. Cl.[5] ..... A41D 25/00; A41D 27/12

[52] U.S. Cl. ..... 2/52; 2/144

[58] Field of Search ..... 2/144, 145, 46, 49 R, 2/52

[56] References Cited

U.S. PATENT DOCUMENTS

| | | | |
|---|---|---|---|
| 2,423,581 | 7/1947 | Clark | 2/49 R |
| 2,659,481 | 11/1953 | Jones | 2/46 X |
| 2,830,297 | 4/1958 | Sabee | 2/49 R |
| 2,915,757 | 12/1959 | Sofio, Sr. | 2/46 |
| 3,085,247 | 4/1963 | Bixby | 2/144 X |
| 3,639,916 | 2/1972 | Vaughn | 2/145 X |
| 3,714,669 | 2/1973 | Vorbau | 2/46 |
| 3,833,937 | 9/1974 | Taylor | 2/49 R X |
| 4,453,273 | 6/1984 | Gerrick | 2/144 X |
| 4,888,827 | 12/1989 | Lee | 2/52 |

*Primary Examiner*—Daniel M. Yasich

*Attorney, Agent, or Firm*—H. Gibner Lehmann; K. Gibner Lehmann

[57] ABSTRACT

A protective shield for a four-in-hand tie which is being worn by a user, comprises a thin, elongate disposable cardboard-like sheet having a width and length which are sufficient to cover the frontal exposed portion of the tie. At one end the sheet has a tab which is adapted to be folded backward and downward so that it can be inserted in the knot of the tie from the top thereof. Intermediate its ends the sheet has fastener portions enabling it to be secured to the frontal portion of the tie so as to position the sheet in front of the tie and prevent any soiling thereof while dining.

11 Claims, 1 Drawing Sheet

18
24
26
28
30
10
22
12
32
16
20
14
27
34
36
10a

TIE PROTECTOR SHIELD

BACKGROUND OF THE INVENTION

1. Field of the Invention

This invention relates to protective shields for ties, and more particularly to shielding covers which are attachable to four-in-hand ties being worn by a user.

2. Description of the Related Art

Conventional ties are subjected to inadvertent soiling when the wearer dines. Drops of food or drink often fall onto the exposed surface of the tie, frequently being unnoticed until a later time, resulting in an unsightly stain.

The material of which ties are constituted usually necessitates dry cleaning as opposed to conventional laundering. Today, the cost of dry-cleaning a tie is such that it is not economically practical to have the tie cleaned; rather, severely soiled ties are often discarded and replaced. This practice is both costly and wasteful. In addition, many times it results in the loss of a "favorite" piece of wearing apparel, which may have been the gift of a relative or close friend. Along with the loss of the tie itself goes any inherent sentimental value that might be attributable to it.

Efforts to minimize soiling of wearing apparel while one is dining have met with varying degrees of success. In particular, many seafood restaurants issue, free to the customer, "bibs" of one sort or another, especially for use with entrees such as lobster or crab, which usually are served with relatively watery, butter or spiced sauce that is prone to dripping or running.

While existing bibs have been found to accomplish the desired objective, they are unsightly, since they are constituted of light-colored, tissue-like material and are relatively stiff, bulky, and uncomfortable to wear. In addition, they conceal the wearer's attire, thus detracting from the overall neat, dressy appearance he or she frequently wishes to project.

SUMMARY OF THE INVENTION

The problem noted above with soiled ties, and the disadvantages and drawbacks of existing dining "bibs" are largely obviated by the present invention.

Accordingly, an object of the present invention is to provide a novel and improved cover or shield for a four-in-hand tie which is being worn, which shield is especially simple and economical to fabricate, and is disposable after use if this is to be desired.

Another object of the invention is to provide an improved tie shield as above set forth, which can be economically made of thin cardboard, thick paper, or of paper-like material, and which can be readily imprinted with various types of ornamentation simulating an actual tie.

Still another object of the invention is to provide an improved tie shield as above characterized, which can be formed entirely of a single piece of sheet material.

A further object of the invention is to provide an improved tie shield in accordance with the foregoing, which can be readily mass-produced by existing printing, stamping or die-cutting equipment.

Yet another object of the invention is to provide an improved tie shield of the kind indicated, which is capable of various, different ornamentation as effected by printing processes.

A still further object of the invention is to provide an improved tie shield as characterized, wherein advertising or promotional copy can be readily incorporated for display when the shield is being worn.

A feature of the invention is the provision of a tie shield which can be readily folded to occupy a small space, as for purposes of packing, storage, shipping and handling.

Another feature of the invention is the provision of a tie shield which is especially effective when in use, to prevent soiling of the tie being worn by the user.

Still another feature of the invention is the provision of a tie shield as above, which can be easily and quickly applied to the user's tie, and which is child safe at all times.

The above objects are accomplished by a protective shield for a four-in-hand tie which is being worn by a user, comprising a thin, elongate sheet having a width and length which are sufficient to cover the frontal exposed portion of the tie, the sheet having at one end an end tab constituting an extension of the sheet, the tab being adapted to be folded backward and downward so that it can be inserted in the knot of the tie from the top thereof. The sheet has a portion intermediate its ends which is adapted to be secured to the frontal portion of the tie so as to position the sheet in front of the tie and prevent soiling thereof during eating. The arrangement is such that the shield can be readily placed in position at the beginning of the meal, providing a continuous protection of the tie against inadvertent spills or drippings, and removed and discarded thereafter. Undesirable staining of the tie itself is effectively eliminated.

Other features and advantages will hereinafter appear.

DESCRIPTION OF THE PREFERRED EMBODIMENT

Figures 1, 2, 3, 4, 5, 6:
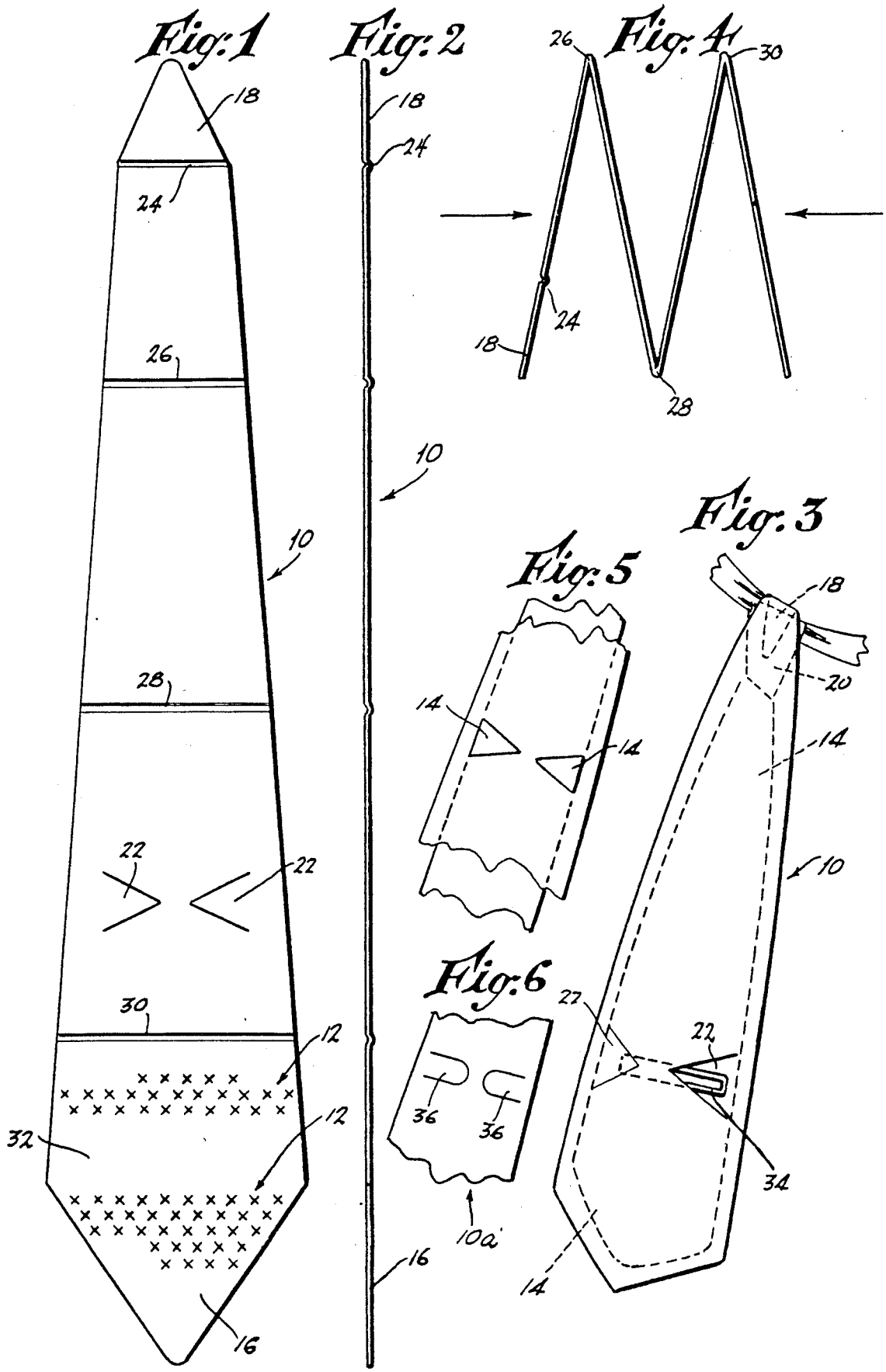
FIG. 1 is a front elevational view of a tie protective shield as provided by the invention.
FIG. 2 is a side edge view of the shield of FIG. 1.
FIG. 3 is a perspective view of the shield of FIG. 1 as applied to the tie of a user, in the special case where the shield is to be held by a tie clasp that is being worn.
FIG. 4 is a side edge view of the shield partly folded, to illustrate the packing and storage feature.
FIG. 5 is a fragmentary perspective view of intermediate portions of the shield applied to a tie, illustrating the usual or normal way of clipping the shield in place on the frontal panel of the tie.
FIG. 6 is also a fragmentary perspective view of an intermediate portion of the tie shield, illustrating a modification of the tie-securing means thereof.

Referring first to FIGS. 1 and 2, the present improved tie shield as shown therein comprises a thin, elongate tapered member generally designated by the numeral 10, constituted of sheet material such as thick paper, thin cardboard or similar stock which can have imprinted thereon various ornamental designs some of which are shown and designated 12, so as to simulate a four-in-hand tie. The sheet 10 has a length and width which are sufficient to cover the frontal exposed portion 14 (FIGS. 3 and 4) of a tie which is being worn by a user.

The sheet 10 is generally of tapered configuration and has at its bottom end a pointed extremity 16. According to the invention, the top or upper portion of the sheet 10 has a pointed extremity or end tab 18 which constitutes an extension of the sheet and which is adapted to be folded backward and downward so that it can be inserted in the knot 20 of the tie from the top thereof, as illustrated in FIG. 3. As is usual with four-in-hand ties, the knot of the tie has a trapezoidal front portion which is shown in FIG. 3 in dotted outline that is located adjacent the end of the lead line for the reference numeral 20. The knot also has a top edge indicated by a broken line, which forms a slit-like opening receives the end tab of the sheet of the shield, with the tab being disposed immediately behind and in contact with the trapezoidal front portion of the knot.

Also, according to the invention, the sheet 10 has a portion intermediate its ends, which is adapted to be secured in front of the frontal portion 14 of the tie, so as to position the sheet in front of the tie and prevent soiling thereof during a meal. In accomplishing this, one or several die-cuts are made in the sheet 10, forming clamping tabs 22 to enable insertion between them, of the frontal portion 14 of the tie as shown in FIG. 5 for instance.

To facilitate the proper bending of the uppermost end tab 18 of the sheet 10, a fold line 24 is formed in the sheet, as by embossing the sheet as seen in FIG. 2.

In accordance with the invention, the sheet 10 is so constituted that it can be conveniently folded into a small and compact package, as for packing, storage and shipping, and also to enable it to be saved for any future use. However, the shield of the invention is also so inexpensive to fabricate that it can be considered a throw-away item, to be discarded after the meal, especially if it has become soiled.

In accomplishing the easy folding, the shield is given additional fold lines 26, 28 and 30 whereby it can be compacted by folding as shown in FIG. 4.

Space 32 can be provided on the sheet 10 to enable promotional or advertising material to be imprinted thereon.

If the wearer of the tie has a tie clasp, such as that indicated in FIG. 3 at 34 to hold the tie in place, such clasp can be used to clip onto a tab 22 for securement of the sheet 10. In instances where the frontal portion 14 of the tie has a dimension which is not suitable to enable it to be clamped between the tabs 22, the existing clasp 34 can be utilized, as will be understood.

Whereas the clamping tabs 22 are shown as having a triangular configuration, other shapes can be utilized, as for instance the rounded-end shapes shown in FIG. 6, of the clamping tabs 36 in the sheet 10*a*.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty of validity.

What is claimed is:

1. In combination with a four-in-hand tie having a knot presenting a trapezoidal front portion with a top edge defining a slit-like opening in the knot, a protective shield for said tie comprising a thin, elongate sheet having a width and length which are sufficient to cover the frontal exposed portion of the tie, said sheet having at one end an end tab constituting an extension of the sheet, said end tab being folded backward and downward and being inserted into the knot of the tie over the said top edge thereof and into the slit-like opening so as to be disposed immediately behind and in contact with the said trapezoidal front portion of the knot, said sheet having a portion intermediate its ends which is adapted to be secured to the frontal portion of the tie so as to position the sheet in front of the tie and prevent soiling thereof during eating.

2. A shield for a tie as set forth in claim 1, wherein:
(a) said sheet is constituted of cardboard having an imprintable facing.

3. A shield for a tie as set forth in claim 1, wherein:
(a) the sheet has a fold line at the juncture of the tab with the remainder of the sheet.

4. A shield for a tie as set forth in claim 1, wherein:
(a) the sheet has multiple transverse fold lines enabling it to be folded over on itself a multiplicity of times, into a small and compact package.

5. A shield for a tie as set forth in claim 4, wherein:
(a) the fold lines of the sheet are embossed therein.

6. A shield for a tie as set forth in claim 1, wherein:
(a) the sheet has ornamentation on one side,
(b) said sheet having a blank space located in said ornamentation, to receive promotional or advertising material.

7. A shield for a tie as set forth in claim 1, wherein:
(a) the said intermediate portion of the sheet, which is adapted to be secured to the frontal portion of the tie, has a die cut to enable insertion of an object to which the sheet is to be secured.

8. A shield for a tie as set forth in claim 1, wherein:
(a) the said end tab is pointed.

9. A protective shield for a four-in-hand tie which is being worn by a user, comprising a thin, elongate sheet having a width and length which are sufficient to cover the frontal exposed portion of the tie, said sheet having at one end an end tab constituting an extension of the sheet, which end tab is adapted to be folded backward and downward so that it can be inserted in the knot of the tie from the top thereof, said sheet having a portion intermediate its ends which is adapted to be secured to the frontal portion of the tie so as to position the sheet in front of the tie and prevent soiling thereof during eating, the said intermediate portion of the sheet, which is adapted to be secured to the frontal portion of the tie, having a pair of die cuts producing oppositely-directed tabs between which the frontal portion of the tie can be inserted and gripped, thereby to position the sheet with respect to the tie.

10. A shield for a tie as set forth in claim 9, wherein:
(a) the pair of die cuts forms tabs which are pointed and which extend towards each other from the opposite edges of the sheet.

11. A shield for a tie as set forth in claim 9, wherein:
(a) the pair of die cuts forms tabs which are rounded and which extend toward each other from opposite side edges of the sheet.

* * * * *